US008042302B2

(12) United States Patent
Krüger et al.

(10) Patent No.: US 8,042,302 B2
(45) Date of Patent: Oct. 25, 2011

(54) WINDOW PANE FOR A MOTOR VEHICLE

(75) Inventors: Harald Krüger, Erlangen (DE); Olaf Kriese, Lautertal (DE); Markus Schultz, Nürnberg (DE)

(73) Assignee: Brose Fahrzeugteile GmbH & Co KG, Coburg, Coburg (DE)

( * ) Notice: Subject to any disclaimer, the term of this patent is extended or adjusted under 35 U.S.C. 154(b) by 771 days.

(21) Appl. No.: 11/794,181

(22) PCT Filed: Dec. 13, 2005

(86) PCT No.: PCT/DE2005/002279

§ 371 (c)(1),
(2), (4) Date: Apr. 25, 2008

(87) PCT Pub. No.: WO2006/069559

PCT Pub. Date: Jul. 6, 2006

(65) Prior Publication Data

US 2009/0019775 A1 Jan. 22, 2009

(30) Foreign Application Priority Data

Dec. 27, 2004 (DE) ..... 10 2004 063 514

(51) Int. Cl.
*B60J 1/16* (2006.01)

(52) U.S. Cl. ..... 49/375; 49/352

(58) Field of Classification Search ..... 49/348, 49/349, 352, 375, 374
See application file for complete search history.

(56) References Cited

U.S. PATENT DOCUMENTS 3,844,064 A * 10/1974 Yamaha et al. ..... 49/348
4,109,417 A * 8/1978 Fogarollo ..... 49/352
4,494,336 A * 1/1985 Ishii et al. ..... 49/352
4,502,247 A * 3/1985 Kobayashi et al. ..... 49/352
4,658,546 A 4/1987 Moriyama
4,700,508 A * 10/1987 Kollner et al. ..... 49/352

(Continued)

FOREIGN PATENT DOCUMENTS

DE 28 47 404 5/1980

(Continued)

OTHER PUBLICATIONS

European Examination Report dated Oct. 14, 2010 for Application No. 05 826 546.3, 4 sheets and English translation summary—Communication according to Article 94(3) EPC dated Oct. 14, 2010, 2 sheets.

(Continued)

*Primary Examiner* — Jerry Redman
(74) *Attorney, Agent, or Firm* — Christie, Parker & Hale, LLP

(57) ABSTRACT

A window pane for a motor vehicle including plastic for closing a pane opening of a motor vehicle and which is moveable with a window lifter out of the pane opening includes a pane element enclosed by an outer edge and a device provided on the pane element for coupling the window pane to an adjusting mechanism of the window lifter. For coupling the window pane to the adjusting mechanism of the window lifter, a guide region is formed on a surface of the pane element via which the window pane is engageable with a guide device of the adjusting mechanism, displaceable in a direction of adjustment. The guide region forms at least one stop, which counteracts a pivoting of the window pane about an axis extending perpendicular to a plane of the window pane.

26 Claims, 5 Drawing Sheets

U.S. PATENT DOCUMENTS

| | | | | |
|---|---|---|---|---|
| 4,759,653 | A * | 7/1988 | Maekawa et al. | 403/24 |
| 4,782,629 | A | 11/1988 | Mori et al. | |
| 4,922,783 | A * | 5/1990 | Wallace | 74/502.4 |
| 5,009,035 | A * | 4/1991 | Kuki et al. | 49/352 |
| 5,022,184 | A * | 6/1991 | Yamamura et al. | 49/352 |
| 5,673,515 | A * | 10/1997 | Weber et al. | 49/352 |
| 5,864,987 | A * | 2/1999 | Mariel et al. | 49/352 |
| 5,970,658 | A * | 10/1999 | Smith | 49/352 |
| 6,052,947 | A * | 4/2000 | Smith | 49/352 |
| 6,088,965 | A * | 7/2000 | Fukumoto et al. | 49/352 |
| 6,115,966 | A * | 9/2000 | Shibata | 49/352 |
| 6,141,910 | A | 11/2000 | Kobrehel et al. | |
| 6,604,325 | B2 * | 8/2003 | Nicolai et al. | 49/348 |
| 6,688,043 | B1 * | 2/2004 | Feder et al. | 49/352 |
| 6,874,279 | B1 * | 4/2005 | Weber et al. | 49/352 |
| 7,076,918 | B2 * | 7/2006 | Tatsumi et al. | 49/352 |
| 7,213,370 | B2 * | 5/2007 | Dedrich et al. | 49/358 |
| 7,617,633 | B2 * | 11/2009 | Shimura et al. | 49/349 |
| 2002/0069586 | A1 * | 6/2002 | Nicolai et al. | 49/375 |
| 2004/0074149 | A1 * | 4/2004 | Tatsumi et al. | 49/352 |
| 2004/0187389 | A1 * | 9/2004 | Santaolalla Gil et al. | 49/352 |
| 2004/0194391 | A1 * | 10/2004 | Castellon | 49/374 |
| 2004/0237410 | A1 * | 12/2004 | Cardine et al. | 49/352 |
| 2006/0059781 | A1 * | 3/2006 | Berklich et al. | 49/352 |
| 2007/0193119 | A1 * | 8/2007 | Hoffman | 49/352 |
| 2008/0005971 | A1 * | 1/2008 | Dickie et al. | 49/349 |
| 2008/0236049 | A1 * | 10/2008 | Arimoto | 49/352 |
| 2009/0007495 | A1 * | 1/2009 | Smith | 49/352 |

FOREIGN PATENT DOCUMENTS

| | | | |
|---|---|---|---|
| DE | 36 31 945 | C2 | 4/1987 |
| DE | 37 18 124 | C1 | 12/1988 |
| DE | 42 10 035 | A1 | 9/1993 |
| DE | 197 03 720 | A1 | 7/1998 |
| DE | 199 09 088 | A1 | 9/2000 |
| DE | 199 44 965 | A1 | 3/2001 |
| DE | 100 45 804 | A1 | 3/2002 |
| DE | 100 61 149 | A1 | 6/2002 |
| DE | 102 16 237 | A1 | 10/2003 |
| DE | 102 34 099 | A1 | 2/2004 |
| EP | 1 367 205 | A2 | 12/2003 |

OTHER PUBLICATIONS

English translation of International Preliminary Report on Patentability for corresponding PCT application No. PCT/DE2005/002279, dated Sep. 18, 2007.

International Search Report, dated Apr. 25, 2006, corresponding to PCT/DE2005/002279.

Partial English translation of DE 28 47 404 listed above.

* cited by examiner 2
13
21
11
1
42
41
40
23
20
10
3
1B
1B
43
44
14a
14
12
4
22
25
Z
X
01
02
17
47
17a
47a
46
16
14a
1
30
Y 1
2
3
4
10
11
12
13
14
14a
16
17
17b
18
18a
19
20
21
22
23
25
30
40
41
42
43
44
46
47
47b
48
48a
49
01
02
2B
X
Y
Z 23
2
13
21
11
1
42
41
40
3
3B
20
10
43
44
14a
14
12
22
25
Q
4
Z
X
Q
P
16
17a
01
02
17
47
47a
46
47a
47
17a
14a
1
17
44
30
Y
X

WINDOW PANE FOR A MOTOR VEHICLE

CROSS-REFERENCE TO A RELATED APPLICATION

This application is a National Phase Patent Application of International Patent Application Number PCT/DE2005/002279, filed on Dec. 13, 2005, which claims priority of German Patent Application Number 10 2004 063 514.5, filed on Dec. 27, 2004.

BACKGROUND

The invention relates to a window pane for a motor vehicle.

Such a window pane consisting of plastic is provided for closing a pane opening (in particular defined by means of a window frame) of a motor vehicle, and may be moved by means of a window lifter out of the pane opening and brought again into its closed position in the pane opening. The window pane comprises a pane element enclosed by an outer edge as well as a device arranged on the pane element for coupling the window pane to an adjusting mechanism of the window lifter.

In this case, the term 'window frame' is generally understood to be a restriction to a window opening in a motor vehicle, which may be closed by a window pane provided to this end (which is adjustable by means of a window lifter). In this case, the restriction is, for example, arranged on a motor vehicle door (in particular a folding door or sliding door) or a restriction arranged on an immovable region of the bodywork of a motor vehicle, defining (and at least partially enclosing) a pane opening denoted as a frame. With so-called frameless vehicle doors which are used, in particular, with convertible vehicles, the associated window frame is formed by a region of the restriction of the door opening on the bodywork side, which may be closed by the corresponding vehicle door. The part of the restriction of the door opening which defines, according to its intended purpose, the window pane provided on the vehicle door when the vehicle door is closed, is considered as the window frame (in the case of an adjustable window pane, a window pane in its closed position is taken as a starting point).

It is generally known in the prior art to fasten a drive element to a window pane, in particular to the lower edge thereof, via which the window pane is connected to the lifting mechanism of an associated window lifter, for example to a cable of a tractive means window lifter or to a lever arm of an arm window lifter.

SUMMARY

The object of the invention is to provide a window pane for motor vehicles which is further improved with regard to its connection to an associated motor vehicle window lifter.

Accordingly, for coupling the window pane to the adjusting mechanism of a window lifter, a guide region is integrally formed on the pane element which projects from a surface of the pane element and via which the window pane engages positively and longitudinally displaceably with guide means of the adjusting mechanism.

Said guide region is arranged and configured, in particular, such that when the window lifter is engaged in associated guide means it prevents a pivoting of the window pane about an axis extending perpendicular to the pane plane.

The guide region of the window pane may, on the one hand, be formed from the same material as the remaining pane element of the window pane or may be formed on the pane element from a different material, according to the so-called two-component technique.

So that a pivoting of the window pane is prevented about an axis extending perpendicular to the pane plane, when the window pane is in engagement via its guide region with associated guide means of the window lifter, the guide region comprises at least two stops spaced apart from one another transversely to the direction of adjustment of the window pane, via which the window pane is able to be supported on associated guide means. With such stops, moreover, a pivoting of the window pane about an axis extending parallel to the direction of adjustment may also be prevented.

According to an exemplary embodiment of the invention, the guide region comprises an undercut into which the associated guide means of the window lifter are able to engage. As a result, in addition to a pivoting of the window pane about an axis extending perpendicular to the pane plane, a slipping of the window pane perpendicular to the pane plane may also be prevented.

According to an exemplary embodiment of the invention the guide region is arranged on the lower edge and/or in the immediate vicinity of the lower edge of the window pane—relative to the state of the window pane installed in a motor vehicle. As a result, a particularly long lever arm is provided for supporting the window pane against pivoting.

According to one exemplary embodiment, the guide region comprises a projection extending in the direction of adjustment of the window pane for acting in associated guide means, the lateral faces of the projection opposing one another perpendicular to the direction of adjustment forming stops, by means of which a pivoting of the window pane, in particular about an axis extending transversely to the pane plane, is able to be prevented.

According to a further exemplary embodiment, the guide region of the window pane comprises a receiver (recess) extending in the direction of adjustment, into which the associated guide means are able to engage, lateral defining surfaces of the receiver spaced apart from one another perpendicular to the direction of adjustment forming corresponding stops.

The guide regions may be arranged in a portion of the window pane which is not provided for closing a window opening, for example on an extension of the pane element which projects from the lower edge of the pane element—relative to the installed state of the window pane in a motor vehicle.

Moreover, a receiver may be configured on the window pane, via which the window pane may be connected to a force transmission means of the lifting mechanism, which transmits the adjusting force generated by a drive of the window lifter to the window pane to be adjusted. In this case, said receiver may, for example, be a nipple chamber which is provided for positively receiving a cable nipple of a tractive means window lifter, in order to transmit the forces acting on the tractive means during the operation of the window lifter to the window pane to be adjusted.

BRIEF DESCRIPTION OF THE DRAWINGS

Further details and advantages of the invention will become apparent from the following description of embodiments with reference to the figures, in which.

DETAILED DESCRIPTION

Figures 1A, 1B:
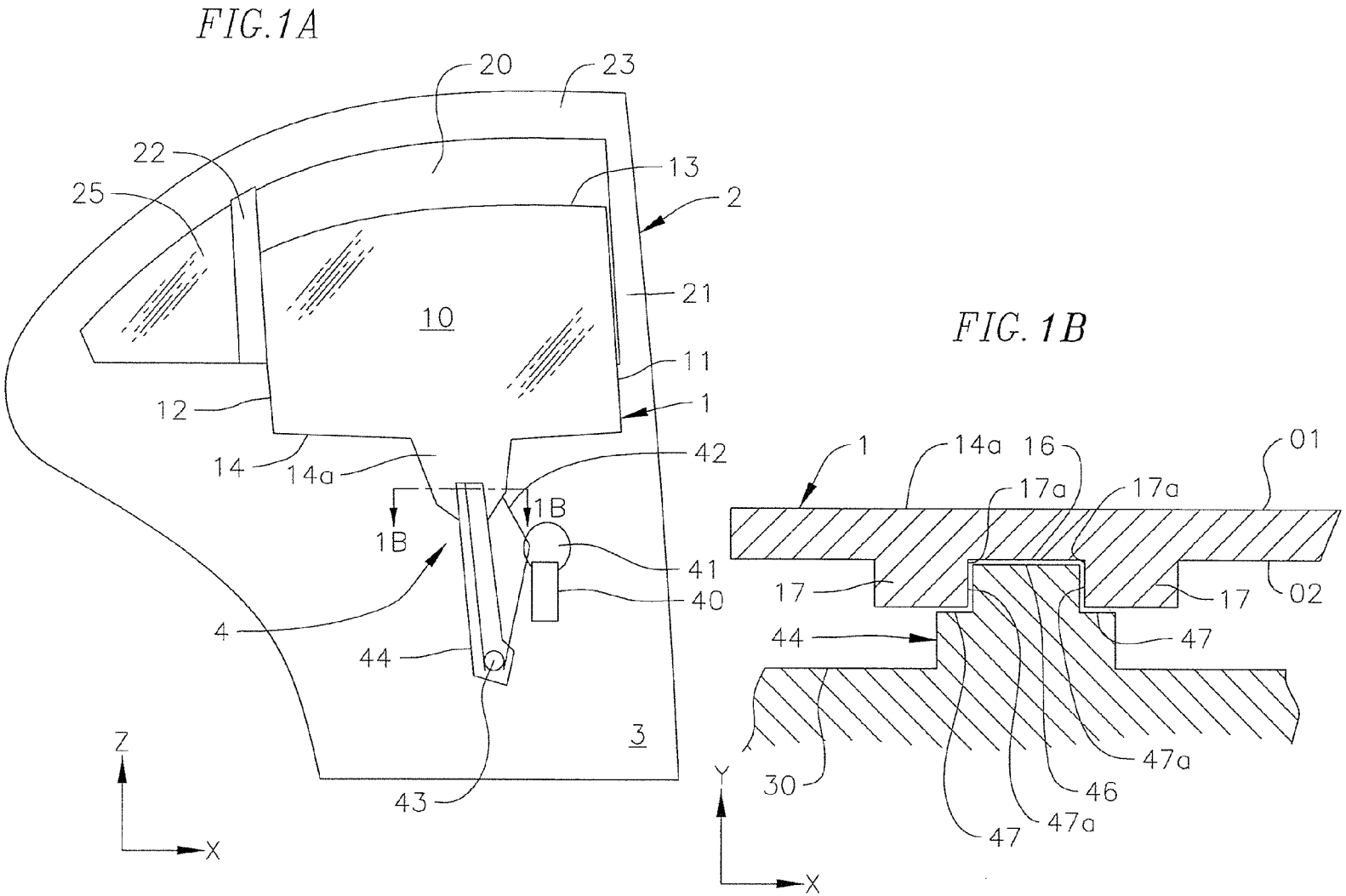
FIG. 1*a* shows a door assembly for a motor vehicle with an adjustable window pane, into which a guide region for guiding the window pane in a direction of adjustment is integrally incorporated.
FIG. 1*b* shows a cross section through the guide region of the window pane of the door assembly of FIG. 1*a*.

A door assembly of a motor vehicle door is shown in FIG. 1*a*, which comprises a door body 3 with a window frame 2, as well as a displaceably mounted window pane 1 with an associated window lifter 4.

By means of two lateral frame portions 21, 22 spaced apart from one another—relative to the state installed in a motor vehicle—as well as an upper frame portion 23 on the roof side connecting said frame portions, the window frame 2 defines a pane opening 20 which may be closed by the pane element 10 of the adjustable window pane 1. The pane element 10 of the adjustable window pane 1 is firstly defined by two edges 11, 12 spaced apart from one another along the longitudinal axis of the vehicle x, as well as further by an upper edge 13 and a lower edge 14 at a distance therefrom along the vertical vehicle axis z, which comprises an extension 14*a* for connecting the window pane to the window lifter 4.

Between the one lateral frame portion 22 and a curved region of the upper frame portion 23 of the window frame 2 a (non-adjustable) triangular window 25 is additionally arranged, which may be integrally formed on the window frame 2 when using plastic as a material for said window frame 2. By using the so-called two-component technique during the manufacture of the window frame 2, an opaque, for example non-transparent, plastic component for manufacturing the frame portions 21, 22, 23 may be combined in this case with a transparent plastic component for manufacturing the triangular window 25.

A window lifter 4 serves for adjusting the window pane 1 in a direction of adjustment z, which coincides with the vertical vehicle axis, the components of said window lifter being arranged on a region of the door body 3 located below the window opening 20. Said region of the door body 3 is generally formed by a door outer skin and a door inner skin, which enclose a hollow space therebetween denoted as a door shaft. In this case, the door outer skin defines an outer design surface of the motor vehicle door, whilst the door inner skin—relative to the state of the door installed in a motor vehicle—faces the vehicle interior.

The window lifter 4 comprises a drive 40, 41 formed by a drive motor 40 and a gear mechanism 41 downstream thereof, with a rotatably mounted cable drum about which a tractive means 42 of the window lifter, formed by a cable, is wound, and which during operation of the motor 40 is rotated in the one or the other direction. The tractive means 42 is guided by means of deflection elements 43, in particular in the form of guide pulleys, in a segment along a guide rail 44 extending in the direction of adjustment z of the window pane and serves as force transmission means for transmitting an adjusting force generated by the drive 40, 41 to the window pane 1 to be adjusted. The tractive means 42 serving as force transmission means, the associated deflection elements 43 and the guide rail 44 thus form a lifting mechanism, by means of which it is possible to raise and lower the window pane 1 by means of the adjusting force generated by the drive 40, 41.

Figure 5B:
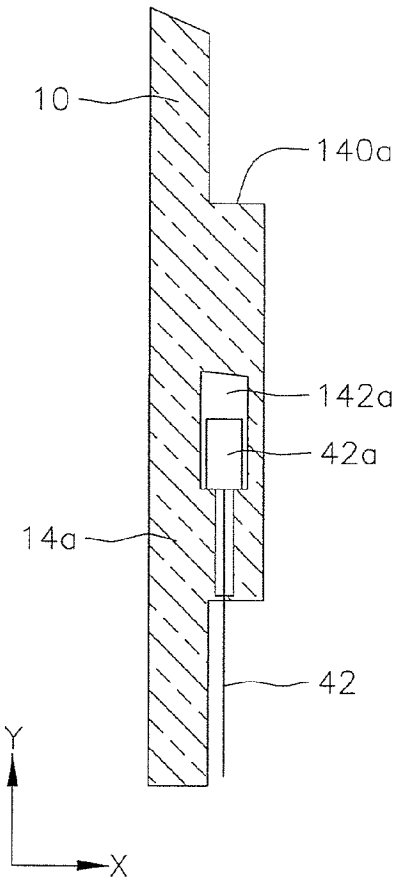
FIG. 5*b* shows a cross section through the door assembly of FIG. 5*a* in a receiver region of the window pane in which a force transmission means of the window lifter is fixed.
Figure 5A:
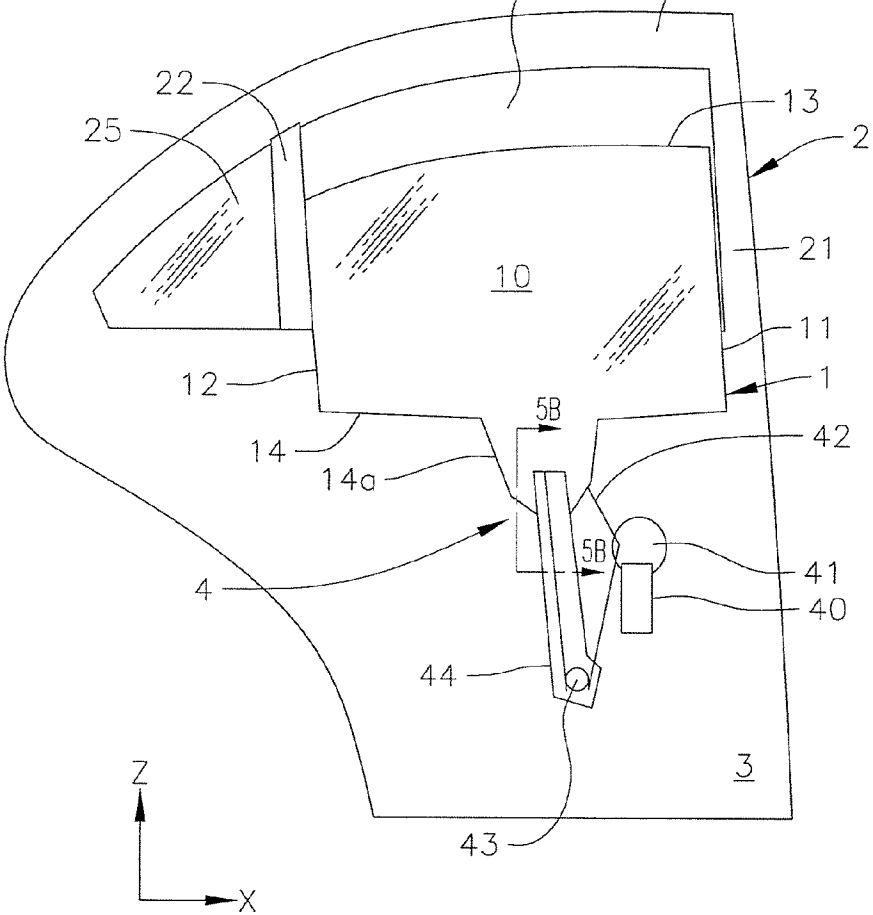
FIG. 5*a* shows a door assembly according to FIG. 1*a*.

To this end, according to FIGS. 5*a* and 5*b*, a receiver region 140*a* with a nipple chamber 142*a* is formed on an extension 14*a* projecting from the lower edge 14 of the window pane 1, which chamber positively receives a cable nipple 42*a* of the tractive means 42.

For the defined guidance of the window pane 1, said window pane according to FIGS. 1*a* and 1*b* is in defined engagement with the guide rail 44 of the window lifter 4, via a guide region 16, 17. The guide rail 44 is, in this case, preferably integrally formed on a support 30 consisting of plastic which forms a component of the door inner skin of the door body 3, as known for example from DE 199 44 965 A1.

The guide rail 44 serving as guide means for guiding the window pane 1 in the direction of adjustment z of the window lifter 4 is, according to FIG. 1*b*, formed by a stepped guide rail region 46, 47, projecting from the support element serving as a door module support, in a direction y perpendicular to the pane plane of the window pane 1. Said guide rail region forms a top surface 46 facing the window pane 1 from which two stops 47*a* spaced apart from one another in the pane plane perpendicular to the direction of adjustment z are bent back, extending parallel to one another, to which respectively one shoulder 47 extending parallel to the pane plane is attached.

A through a receiver 16, 17 extending in the direction of adjustment z of the window pane 1 is associated with said guide rail region 46, 47 of the window lifter 4, and which is located in front of the surface O2 of the window pane 1 to be adjusted facing the vehicle interior, i.e. on the side facing away from the outer surface O1 of the window pane 1. Said receiver is formed by two projections 17 spaced apart from one another perpendicular to the direction of adjustment z of the window pane, formed integrally on the window pane 1 and projecting from the inner surface O2 thereof, and which extend respectively in the direction of adjustment z of the window pane, as well as by a bottom surface 16 connecting the two projections 17. Each of the two projections 17 defines a stop 17*a* on the edge side cooperating with one respective opposing lateral stop 47*a* of the guide rail 44, whereby a pivoting of the window pane 1 relative to an axis y extending perpendicular to the pane plane is prevented. Additionally, the cooperation of the bottom surface 16 of the recess 16, 17 on the pane side with the top surface 46 of the guide rail 44 extending parallel to the pane plane and facing the window pane 1 also prevents a pivoting of the window pane 1 about an axis extending parallel to the direction of adjustment z.

By means of this guide region 16, 17 which is formed in the extension 14*a* projecting downward from the lower edge 14 of the window pane 1, the window pane 1 may be guided in a defined manner along the guide rail 44 of the window lifter 4, a pivoting of the window pane both about an axis y extending perpendicular to the pane plane and about an axis z extending parallel to the direction of adjustment being prevented.

A pivoting of the window pane about the other axis x located in the pane plane, extending perpendicular to the direction of adjustment z (longitudinal axis of the vehicle relative to the state of the door assembly installed in a motor vehicle) is prevented by the guidance of the window pane 1 with its lateral edges 11, 12 in associated frame portions 21, 22 of the window frame 2.

Figures 2A, 2B, 2C:
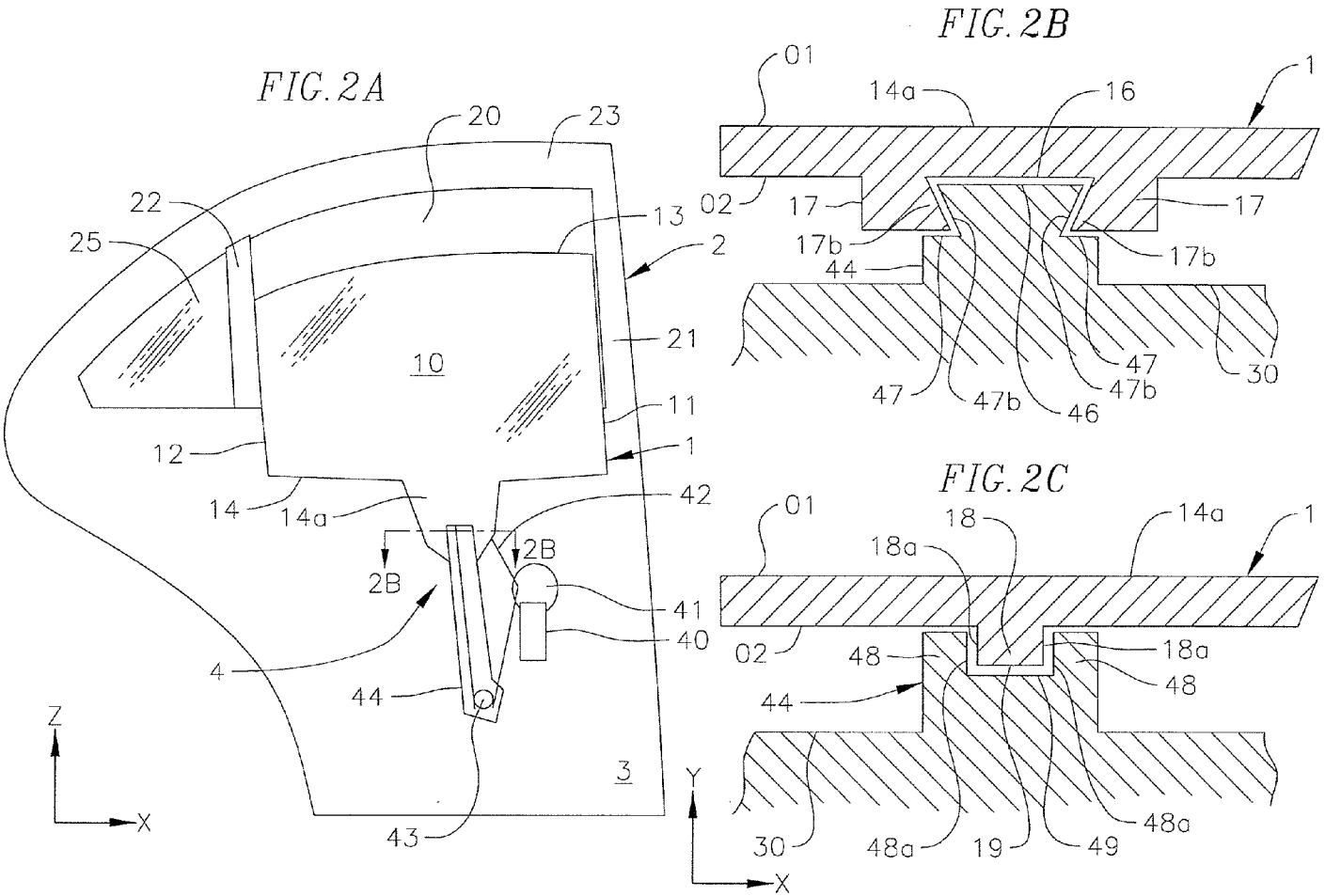
FIG. 2*a* shows a modification of the door assembly of FIG. 1*a*.
FIG. 2*b* shows a modification of the cross section of FIG. 1*b*.
FIG. 2*c* shows a modification of the cross section of FIG. 1*b*.

A development of the door assembly shown in FIGS. 1*a* and 1*b* is shown in FIGS. 2*a* and 2*b*, the difference being that the guide region 16, 17 formed on the window pane 1 forms with the inner stops 17*b* of the projections 17 an undercut, which is engaged from the rear by the opposing lateral stops 47*b* of the guide rail 44 adapted thereto. By this cooperation of the guide region 16, 17 of the window pane 1 with the guide rail 44, a movement of the window pane 1 in a direction y perpendicular to the pane plane 1 and thus also a pivoting of the window pane 1 about the axis x extending perpendicular to the direction of adjustment z in the pane plane is additionally prevented.

FIG. 2*c* shows in cross section a modification of the guide regions and guide rails of FIGS. 1*b* and 2*b*, on the lower extension 14*a* of the window pane 1 a projection 18 being integrally formed as a guide region, which forms two lateral stops 18*a* spaced apart from one another in the pane plane, as well as a top surface 19 extending parallel to the pane plane and which projects in the direction of adjustment z of the window pane 1 from the inner surface O2 of the window pane 1 in the direction of the guide rail 44. A guide rail 44 cooperates with said guide region 18, 19 of the window pane 1, and which in turn is formed integrally on a support element 30 and forms a receiver 48, 49 for the guide region 18, 19 of the window pane 1. Said receiver 48, 49, extending in the direction of adjustment z of the window pane 1, is defined by two stops 48*a* spaced apart from one another perpendicular to the direction of adjustment z, along the pane plane, which are formed by one respective projection 48 of the guide rail 44, as well as by a bottom surface 49 connecting the two projections 48. The cooperation of the lateral stops 18*a* on the window side, with the opposing lateral stops 48*a* on the guide rail side, which substantially bear against one another—except for a small amount of clearance—prevents a pivoting of the window pane about an axis y extending perpendicular to the pane plane and the cooperation of the bottom surface 49 of the recess 48, 49 on the guide rail side with the top surface 19 of the guide region 18, 19 on the window pane side additionally counteracts a pivoting about an axis extending parallel to the direction of adjustment z.

Figures 3A, 3B:
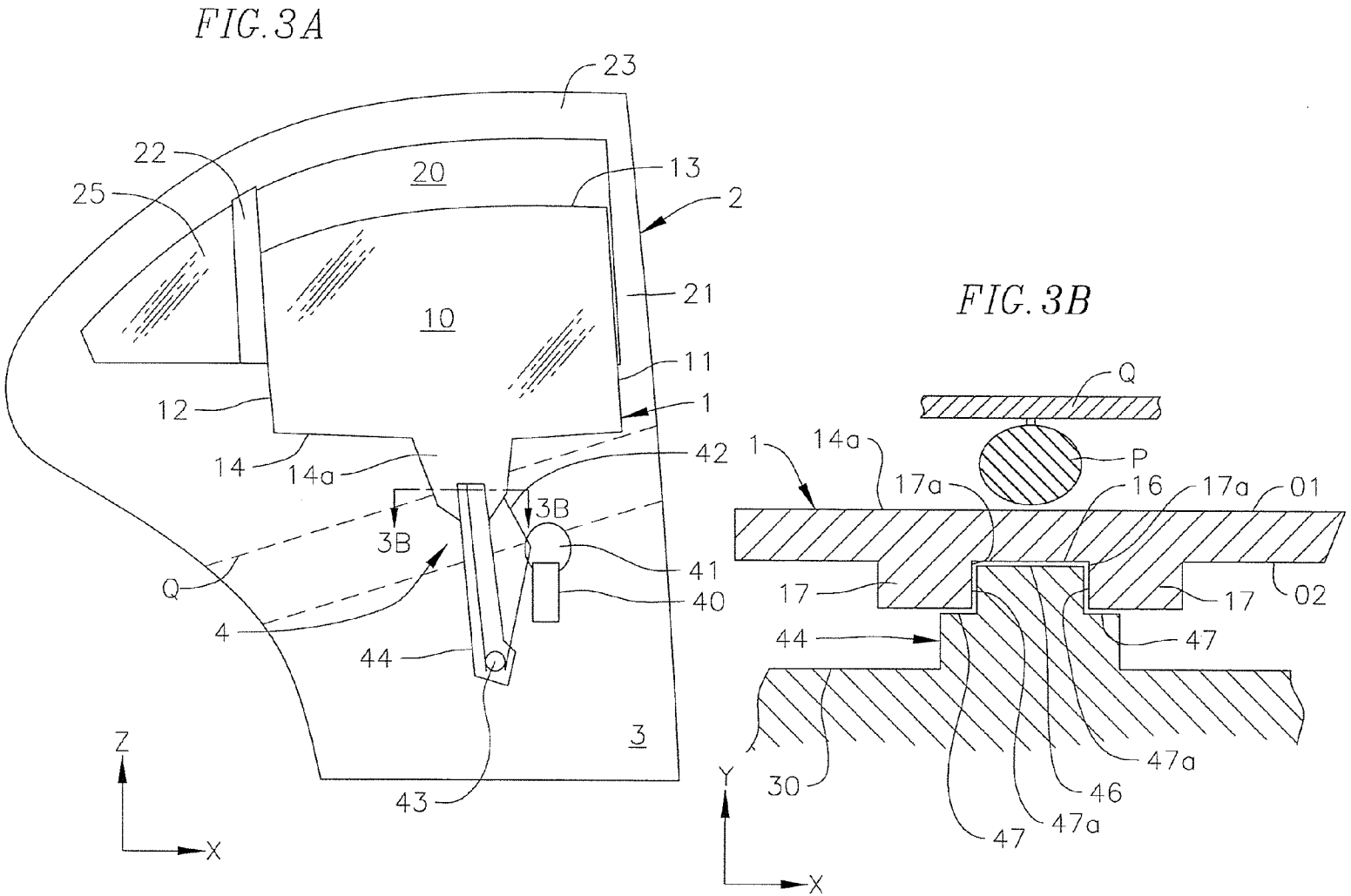
FIG. 3*a* shows a second modification of the door assembly of FIG. 1*a*.
FIG. 3*b* shows a cross section through the door assembly of FIG. 3*a* in the guide region of the window pane.

A development of the door assembly of FIGS. 1*a* and 1*b* is shown in FIGS. 3*a* and 3*b*, a cross member Q extending on the door body 3 in the region of the door casing and which is intended to increase the stiffness of the door body 3 as a side impact member, in particular in the event of a crash. A support element, for example in the form of a pillar P, is arranged on said side impact member Q and which may support the window pane 1 in the lowered state on its side facing away from the guide rail 44, i.e. its outer surface O1. As a result, a movement of the window pane in the direction y transversely to the pane plane, and/or a pivoting of the window pane 1 about an axis x extending in the pane plane transversely to the direction of adjustment z is prevented. The support element P thus preferably consists of plastic, in order to avoid scratching the pane surface O1 facing said support element.

Figures 4A, 4B:
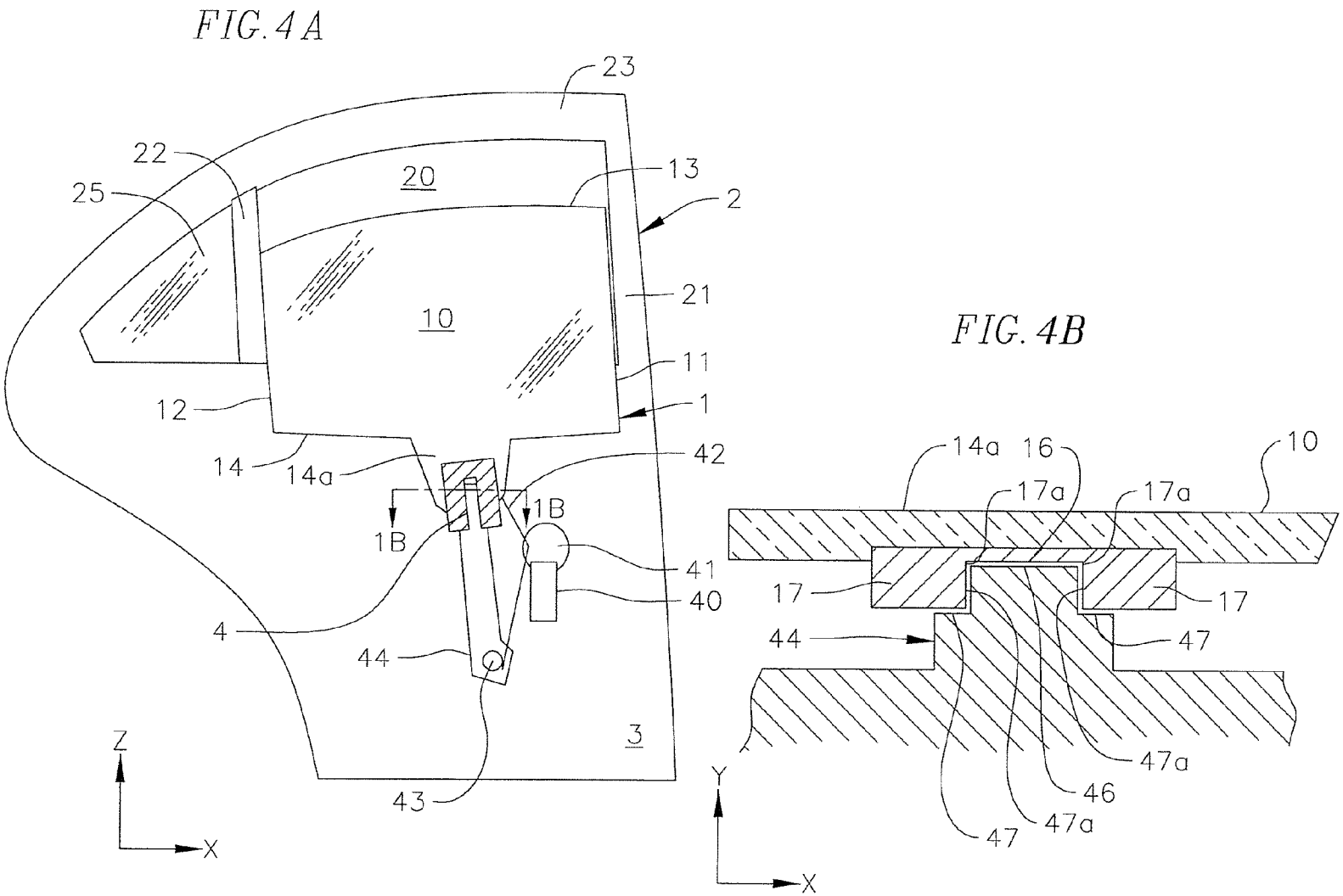
FIG. 4*a* shows a third modification of the door assembly of FIG. 1*a*.
FIG. 4*b* shows a cross section through the door assembly according to FIG. 4*a* in the guide region of the window pane.

Finally, a modification of the door assembly of FIGS. 1*a* and 1*b* is shown in FIGS. 4*a* and 4*b*, in which the guide region 16, 17 formed integrally on the window pane 1, namely on the lower extension 14 thereof, consists of a different material from the pane element 10 thereof. This may be achieved by using the so-called two-component technique when manufacturing the window pane 1, as the pane element 10 thereof and the guide region 16, 17 thereof are formed from different plastics.

In the aforementioned embodiments, the window pane to be adjusted may always be displaced in a direction z which—relative to the state installed in a motor vehicle—substantially coincides with the vertical vehicle axis of a motor vehicle. The arrangement disclosed above with reference to the FIGS. is, however, not in any way restricted to such cases in which the window pane may only be adjusted in a straight line or more specifically only along a vehicle axis (namely the vertical vehicle axis). However, the adjustment of the window pane along curved paths is also expressly intended to be included, so that the direction of adjustment of the window pane is altered locally along its adjustment path. The vertical vehicle axis z thus corresponds to a main direction of adjustment, corresponding to a raising of the window pane into the associated window opening and/or a lowering of the window pane out of the window opening. However, further components of motion in other spatial directions may always be superimposed on such a raising or lowering of the window pane in the vertical direction z.

The invention claimed is:

1. A window pane for a motor vehicle, the window pane comprising plastic and provided for closing a pane opening of a motor vehicle and being moveable out of the pane opening with a window lifter having an adjustment mechanism including a guide device, the window pane comprising:

a pane element; and a guide region for coupling the window pane to the adjustment mechanism of the window lifter;

wherein for coupling the window pane to the adjustment mechanism of the window lifter, the guide region is configured to engage the guide device of the adjusting mechanism, the pane element being displaceable in a direction of adjustment forming at least one stop to counteract a pivoting of the window pane about an axis extending perpendicular to a plane defined by the window pane when the window pane is supported on an opposing stop of the guide device, and wherein the guide region is on an extension of the pane element, wherein the extension of the pane element is outside a periphery of the pane opening and wherein the extension projects from a lower edge of the pane element, viewed in the direction of adjustment, in the plane defined by the window pane.

2. The window pane of claim 1, wherein the guide region projects from a surface of the pane element.

3. The window pane of claim 1 or 2, wherein the pane element comprises two lateral edges spaced apart from one another perpendicular to the direction of adjustment of the window pane, wherein the window pane is configured to be engaged with a window frame displaceably in the direction of adjustment with the two lateral edges, and wherein the guide region is located between said two lateral edges and is spaced apart from each of the two lateral edges.

4. The window pane of claim 1, wherein the guide region comprises a first material and wherein the pane element also comprises the first material.

5. The window pane of claim 1, wherein the guide region comprises a first material and wherein the pane element comprises a second material that is different from the first material.

6. The window pane of claim 1, wherein the guide region comprises at least two stops spaced apart from one another perpendicular to the direction of adjustment of the window pane, and wherein the stops prevent a pivoting of the window pane about an axis extending perpendicular to the plane defined by the window pane.

7. The window pane of claim 1, wherein the guide region comprises at least one stop, wherein when the at least one stop cooperates with an opposing stop of the guide device, the at least one stop counteracts a pivoting of the window pane about an axis extending parallel to the direction of adjustment.

8. The window pane of claim 1, wherein the guide region comprises at least one undercut configured to be engaged by the guide device.

9. The window pane of claim 1, wherein the guide region comprises a projection extending in the direction of adjustment of the window pane and configured to engage in the associated guide device.

10. The window pane of claim 1, wherein the guide region comprises a receiver extending in the direction of adjustment of the window pane, wherein the associated guide device is configured to engage in the receiver.

11. The window pane of claim 1, wherein on the pane element a receiver is formed for fixing a force transmission device of the window lifter.

12. The window pane of claim 11, wherein the receiver serves for receiving a cable nipple of the force transmission device configured as a tractive device.

13. A door assembly for a motor vehicle comprising:

a door body;

a window frame arranged on the door body and defining a pane opening;

a window pane for a motor vehicle, the window pane comprising plastic and provided for closing the pane opening and being moveable outside of the pane opening the window pane comprising:

a pane element; and a guide region on the pane element; and a window lifter arranged on the door body for adjusting the window pane to move between being outside the pane opening and being within the pane opening, the window lifter comprising a guide device for guiding the window pane in a direction of adjustment;

wherein for coupling the window pane to the adjustment mechanism of the window lifter, the guide region is configured to engage the guide device of the adjusting mechanism, the pane element being displaceable in a direction of adjustment forming at least one stop to counteract a pivoting of the window pane about an axis extending perpendicular to a plane defined by the window pane when the window pane is supported on an opposing stop of the guide device; and wherein the guide region is on an extension of the pane element, wherein the extension of the pane element is outside a periphery of the pane opening and wherein the extension projects from a lower edge of the pane element, viewed in the direction of adjustment, in the plane defined by the window pane.

14. The door assembly of claim 13, wherein the guide device is configured to be brought into engagement with the guide region of the pane element positively and displaceably in the direction of adjustment of the window pane.

15. The door assembly of claim 13 or 14, wherein the guide device comprises a receiver into which the guide region of the pane element is configured to engage.

16. The door assembly of claim 13 or 14, wherein the guide device comprises a projection configured to engage in the guide region of the pane element.

17. The door assembly of claim 13, wherein the guide device of the window lifter and the guide region of the pane element engage in one another with undercuts.

18. The door assembly of claim 13, wherein the guide device of the window lifter is formed on a component of the door body.

19. The door assembly of claim 18, wherein the guide device of the window lifter is formed on a component of the door body formed by a component of an inside wall of the door.

20. The door assembly of claim 13, wherein the guide device of the window lifter comprises plastic.

21. The door assembly of claim 20, wherein the guide device is formed on an assembly support of the door body comprising plastic.

22. The door assembly of claim 13, wherein a support device independent of the guide device is provided on the door body, wherein the support device stabilizes the position of the window pane when lowering out of the pane opening in a direction perpendicular to the plane defined by the window pane.

23. The door assembly of claim 22, wherein the support device extends in front of the surface of the pane element facing away from the guide device.

24. The door assembly of claim 22, wherein the support device is arranged on an impact member of the door body.

25. The door assembly of claim 13, wherein the guide region extends on a lower edge of the window pane in the direction of adjustment so that, when the window opening is closed by the window pane, the guide region is not located in the visible region of the door assembly.

26. The door assembly of claim 25, wherein the guide region is not located in the window opening.

* * * * *